US006604314B2

(12) United States Patent
Fluhr

(10) Patent No.: US 6,604,314 B2
(45) Date of Patent: Aug. 12, 2003

(54) BARREL FOR A FIREARM

(75) Inventor: Norbert Fluhr, Oberndorf/Neckar (DE)

(73) Assignee: Heckler & Koch, GmbH, Oberndorf / Neckar (DE)

( * ) Notice: Subject to any disclaimer, the term of this patent is extended or adjusted under 35 U.S.C. 154(b) by 0 days.

(21) Appl. No.: 10/191,600

(22) Filed: Jul. 9, 2002

(65) Prior Publication Data

US 2003/0019141 A1 Jan. 30, 2003

Related U.S. Application Data

(63) Continuation of application No. PCT/EP01/00293, filed on Jan. 11, 2001.

(51) Int. Cl.[7] ..... F41A 21/12
(52) U.S. Cl. ..... 42/76.01; 42/75.02; 89/14.05
(58) Field of Search ..... 42/76.01, 75.02, 42/49.01, 50; 89/14.05

(56) References Cited

U.S. PATENT DOCUMENTS

| | | | | |
|---|---|---|---|---|
| 3,177,603 A | | 4/1965 | Gillespie | 42/75 |
| 4,297,800 A | * | 11/1981 | Atchisson | 42/49.02 |
| 5,585,589 A | * | 12/1996 | Leiter | 89/128 |
| 5,655,326 A | * | 8/1997 | Levavi et al. | 42/70.01 |
| 5,678,340 A | * | 10/1997 | Moon | 42/25 |
| 5,717,156 A | * | 2/1998 | Lenkarski | 89/196 |
| 5,741,996 A | * | 4/1998 | Ruger et al. | 89/196 |
| 5,765,302 A | | 6/1998 | Brandl et al. | 42/18 |
| 5,983,773 A | | 11/1999 | Dionne | 89/29 |
| 6,161,322 A | * | 12/2000 | Liebenberg | 42/1.05 |
| 6,276,252 B1 | * | 8/2001 | Dionne | 89/29 |

FOREIGN PATENT DOCUMENTS

| | | |
|---|---|---|
| DE | 687708 | 1/1940 |
| DE | 687 708 | 1/1940 |
| DE | 82 32 810.2 | 6/1983 |
| DE | 38 18 838 A1 | 12/1989 |
| DE | 195 01 397 | 7/1996 |
| EP | 0 291 474 | 11/1988 |

OTHER PUBLICATIONS

International Search Report in PCT/EP01/00293 dated Jun. 5, 2001.
International Preliminary Examination Report in PCT/EP01/00293 dated Dec. 18, 2001.

* cited by examiner

*Primary Examiner*—Charles T. Jordan
*Assistant Examiner*—John W. Zerr
(74) *Attorney, Agent, or Firm*—Grossman & Flight, LLC

(57) ABSTRACT

Barrels, a breech structured to interact with such barrel(s), and firearms incorporating such barrels and breech are disclosed. The barrels include a cartridge chamber having an internal surface with a curvature. They also include a guide element located adjacent to and extending away from the cartridge chamber. The guide element is located at a point where a transverse movement of a cartridge being loaded ends during a loading process. The guide element has a surface having a circular shape whose curvature corresponds to the curvature of the internal surface of the cartridge chamber.

14 Claims, 7 Drawing Sheets

BARREL FOR A FIREARM

RELATED APPLICATION

This patent arises from a continuation application which claims priority under 35 U.S.C. §120 from International Patent Application No. PCT/EP01/00293 filed Jan. 11, 2001.

FIELD OF THE INVENTION

The invention relates generally to firearms, and more particularly, to a barrel for a firearm.

BACKGROUND OF THE INVENTION

The positional terms that are used in this document, such as "forward," "top," "left," etc., relate to a weapon that is positioned in an ordinary manner to fire a horizontal shot, whereby the direction of shooting proceeds forward away from the shooter. The same convention is applicable to statements about direction ("to the front," "upwardly," "to the left," etc.).

A weapon of the general type discussed herein, in the caliber of 6.35 mm, is known from the Czechoslovakian pistol, CZ 1922. The following publications also describe relevant weapons: DE 195 01 397 A1; DE 82 32 810 U1; and U.S. Pat. No. 5,983,773.

In repeating weapons, the cartridges are generally individually conveyed into the cartridge chamber from a storage unit, such as, for example, a magazine or a cartridge belt. For this purpose, they are first slid from the storage unit and into a transfer position, and slid from the transfer position, such as, for example, by the breech into the cartridge chamber.

The section of the weapon barrel containing the cartridge chamber can be developed as an integral component of the barrel or, as is known from revolver weapons, as a separate component. The number of transfer positions is mostly based upon the construction style of the storage unit. There are, for example, staggered magazines with two transfer positions lying next to one another.

The transfer position(s) are not, as a rule, located directly behind the weapon barrel or the cartridge chamber. Instead, they are frequently positioned below the cartridge chamber or displaced laterally relative thereto (such lateral displacements are necessary if several transfer positions lying next to one another are provided). Thus, as a general rule, a cartridge must cover a construction-caused intermediate interval between one transfer position and the cartridge chamber. At the same time, during this movement, which is referred to in the following as the feeding movement, the position of a cartridge that has been displaced too little or to the side must be corrected far enough that it can be introduced into the cartridge chamber. For this, the cartridge must, in addition to a movement in the longitudinal direction of the weapon, additionally carry out a movement transverse to the longitudinal axis of the weapon, that is to say, the cartridge must be displaced and/or swivelled laterally in the transverse direction of the weapon. In many cases, the latter movement results in the cartridge being located in an oblique position when it reaches the weapon barrel or, stated more precisely, when its tip slides into the cartridge chamber. The cartridge is then, through the additional sliding into the cartridge chamber, oriented horizontally.

In order to guide the cartridges on the specific path, guide elements are, in the known repeating weapons, provided on the weapon barrel or, generally, on fixed components of the weapon, such as the so-called "lips" on the magazine, for example. In addition, recessed notches on the mount of the cartridge chamber, which are intended to facilitate the threading of the cartridges into the cartridge chamber, are already known. Such recessed notches have the disadvantage that the cartridge casing does not lie against the inner wall of the cartridge chamber at this point. This can lead to "inflation" upon the firing of the cartridges, that is to say, to the denting of the casing, if the thickness of the wall at the spot involved is, because of a material error or an inappropriate ammunition, dimensioned too small. The danger of jamming or of a bursting open of the casings in the cartridge chamber, and the jamming or endangering of the gun resulting from such a misfire, is then distinctly greater.

The above-stated, classification-forming weapon barrel of the applicant (DE 195 01 397 A1) has turned out to be a favorable approach. In that approach, a feeding incline for the guiding of the cartridges at least partially bridges over the distance between the cartridge storage unit and the cartridge chamber and is formed as a separate component. The surface of the feeding incline has one or more guiding grooves into which the cartridges are guided from their transfer position into the cartridge chamber. They thereby slide upwardly, in a slightly oblique position, from a lower position (relative to the cartridge chamber), so that their tip "dips" precisely into the cartridge chamber.

This approach has, on the whole, greatly proven its value in actual practice. For a disturbance-free loading process, this approach presupposes a precise manufacture of the feeding incline or of the guiding grooves.

DESCRIPTION OF THE PREFERRED EXAMPLES

Figure 1:
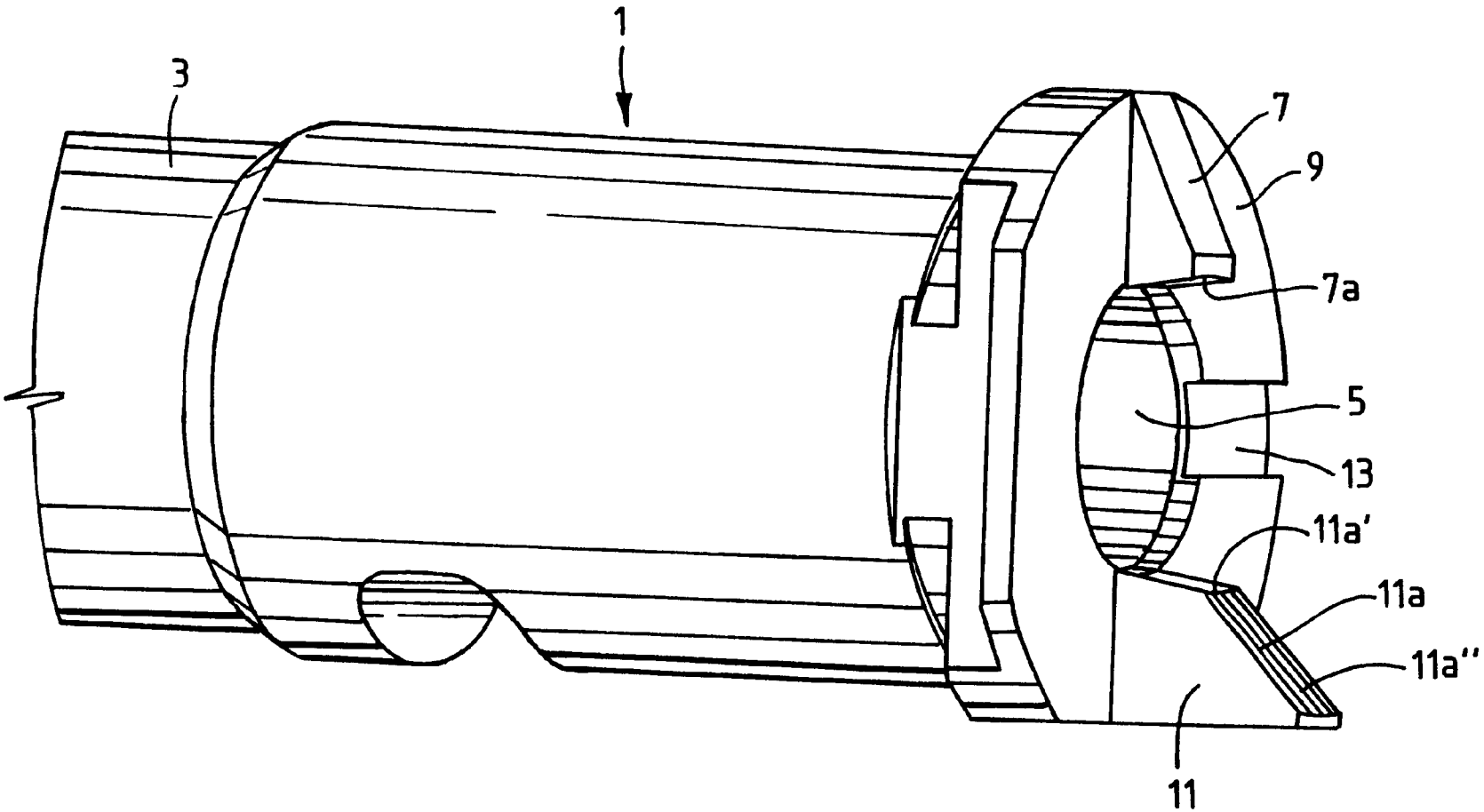
FIG. 1 illustrates a first example of a weapon barrel constructed in accordance with the teachings of the invention.
Figure 6:
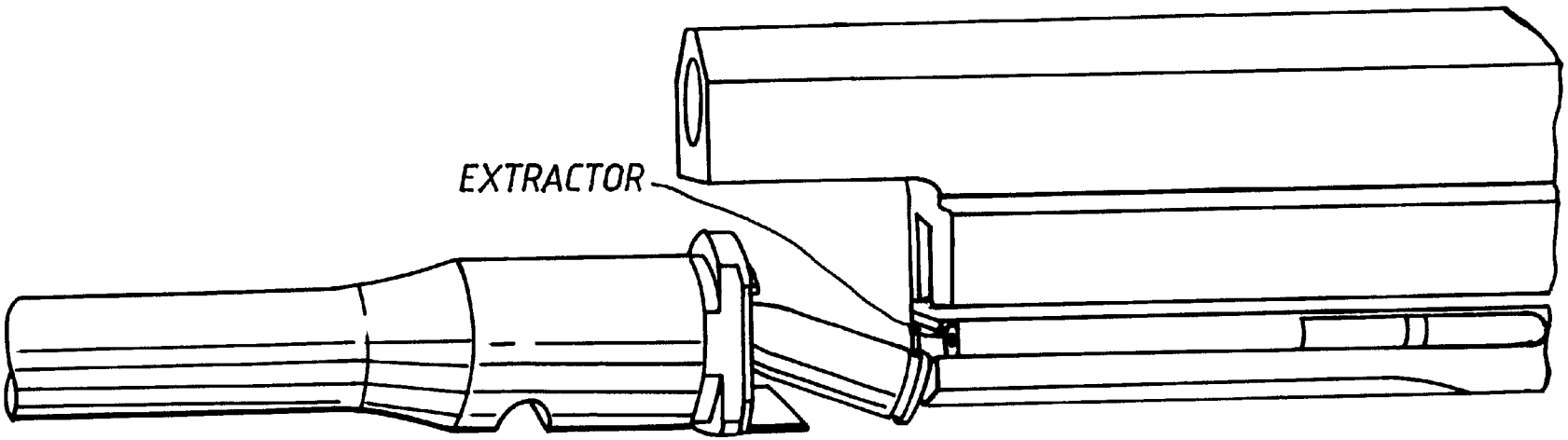
FIG. 6 illustrates the breech of FIG. 5, a barrel, and a cartridge.

FIG. 1 depicts a portion of a barrel (3) of a semi-automatic weapon. The barrel (3) includes a cartridge chamber (5) and a projectile boring (not depicted). The cartridge chamber (5) is located in the rear section (1) of the barrel (3) and discharges forward, proceeding into the projectile boring, so that the central axis of the cartridge chamber (5) is in alignment with the axis of the bore of the barrel (3). The cartridge chamber (5) is dimensioned to receive a cartridge (See FIG. 6).

The barrel (3) has a guide element (7) which is seated on a front surface (9) of the barrel (3) and is an integral component of the same. The guide element (7), which will be referred to in the following as the "guiding lug", is positioned above the cartridge chamber (5) and extends (in the longitudinal direction of the weapon barrel) towards the rear. The guiding lug (7) has an internal surface (7-[*a*]) which is slightly curved, corresponding to the radius of the cartridge chamber (5), and makes a transition into the cartridge chamber (5) in a continuous slight slope.

Furthermore, the barrel (3) is provided with a feeding element (11), which will be referred to in the following as "feeding incline". The feeding incline (11) has an internal surface (11-[*a*]) which is slightly curved, corresponding to the curvature of the cartridge chamber (5). Considered in the longitudinal direction, the feeding incline (11) is gradated in two different oblique sections (11-[*a'*] and 11-[*a''*]), and makes a continuous transition into the cartridge chamber (5).

Furthermore, the barrel (3) has a recess (13) for an extraction claw (See FIGS. 5–6) of the breech associated with the barrel (3).

In order to create a transition between the internal surfaces (7-[*a*], 11-[*a*]) and the cartridge chamber (5) that is as harmonious as possible, the radii of curvature of the internal surfaces (7-[*a*] and 11-[*a*]) correspond to those of the internal diameter of the cartridge chamber (5). Thus, an insertion of a cartridge into the cartridge chamber (5) that is as free of disturbance as possible is guaranteed.

Through the oblique configuration of the internal surface (7-[*a*]) and of the forward section (11-[*a'*]) of the internal surface (11-[*a*]) (each slope amounts to approximately 8 degrees, in relation to the central axis of the cartridge chamber [5]), both of the surfaces continuously move forward towards one another in the longitudinal direction of the weapon. They thus form a type of "beak" for the better accommodation of the cartridges. Because of the curved formation of the internal surfaces (7-[*a*], 11-[*a*]), these surfaces additionally function as guiding grooves in order to hold the cartridges, on a rectilinear path, in the direction of the cartridge chamber (5).

In the present example, the cartridge feeding functions as follows. After the ejection of the casing has been carried out by the post-loading movement of the breech, a new cartridge is slid, from a transfer position (not depicted), in the direction of the cartridge chamber (5). The relative position of the transfer position lies below the cartridge chamber (5), so that the tip of the cartridge bumps against the rear section (11-[*a*"]) of the internal surface ([11-[*a*]). The cartridge is raised and guided upwardly by the slope of this section (11-[*a*"]), in the direction of the cartridge chamber (5) (See FIG. 6). Finally, the tip of the cartridge strikes the internal surface (7-[*a*]) of the guiding lug ([7]) and thereby moves downwardly into a more horizontal position, in which it comes to lie on the first section (11-[*a*']) of the internal surface (11-[*a*]) and is, after that, slid completely into the cartridge chamber (5).

In actual fact, the cartridge feeding is carried out, during the loading process, in a fraction of a second. Thus, the above description is intended to be understood as a greatly simplified model of understanding. The cartridges do not always impact at precisely the same point on the section (11-[*a''*]) or on the internal surface (7-[*a*]). At high post-loading speeds, individual cartridges can even be recoiled by the feeding incline (11) and, after that, impact on the internal surface (7-[*a*]) relatively far to the rear (such as on the spike already mentioned, for example). Such "outliers" would, upon lack of a guiding lug (7), miss the cartridge chamber (5), be placed in front of the cartridge chamber (5) or in front of the front surface (9) in a crooked manner, and thereby bring about jamming. In conventional weapon tubes or barrels (without a guide element such as the guiding lug [7]), such outliers must be opposed by feeding elements designed in a correspondingly elaborate manner. These problems are additionally intensified in relatively short and/or flat-headed cartridges, since these can, because of the more oblique position or the flat tip, miss the cartridge chamber (5) more easily still.

One advantage of the illustrated barrel (3) is that, through the cooperation of the guiding lug (7) with the feeding incline (11), the latter can be configured relatively easily without larger numbers of jammings having to be accepted. This reduces the manufacturing costs with the reliability of the weapon remaining the same. At the same time, a guide element such as the guiding lug (7) is also advantageously used, even in barrels or repeating weapons with precisely configured feeding elements, since the sturdiness of the specific repeating weapon against jammings is increased further still by its inclusion.

From what has been stated above, persons of ordinary skill in the art will appreciate that the guiding lug (7) limits the transverse movement of the cartridges in an upward direction. The guiding lug (7) thereby "catches" cartridges that threaten to miss the cartridge chamber (5) and guides them, upon impacting on the internal surface (7-[*a*]), in the direction of the cartridge chamber (5). A cartridge feeding that guides the cartridges into the track provided and holds them there immediately after these have left their transfer position(s) is thus created through the coordination with the feeding incline (11). Thus, apart from the feeding incline (11), no additional feeding elements are necessary.

Since the cartridges are first guided by the feeding incline (11) and the function of the guiding lug is primarily restricted to catching the cartridge, the guiding lug (7) can, in general, be designed to be shorter than the feeding incline (11). It is evident from the illustrated example that the guide element (7) requires relatively little space and, thus, has an effect that is practically not at all disruptive on other processes, such as, for example, the ejection of the casing.

It is additionally evident from the illustrated example that, because of the presence of the guiding lug (7), recessed notches are not needed on the mount of the cartridge chamber (5). The casings of the cartridges lying in the cartridge chamber (5) are thereby completely positioned against the inner wall of the cartridge chamber (5). Consequently, no danger exists that they will be inflated during the shooting process as already described.

Figure 2:
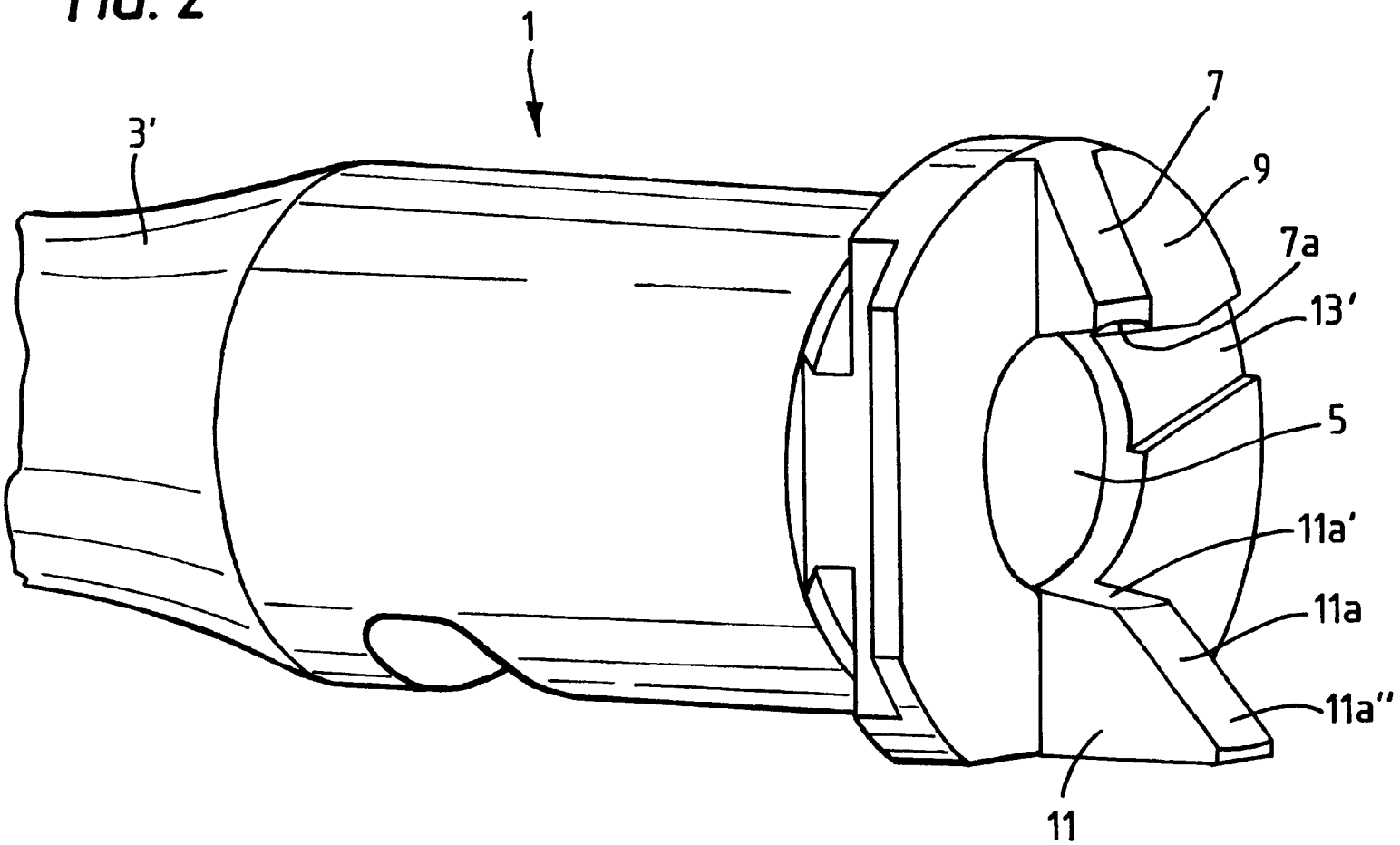
FIG. 2 illustrates a second example of a weapon barrel constructed in accordance with the teachings of the invention.
Figure 3:
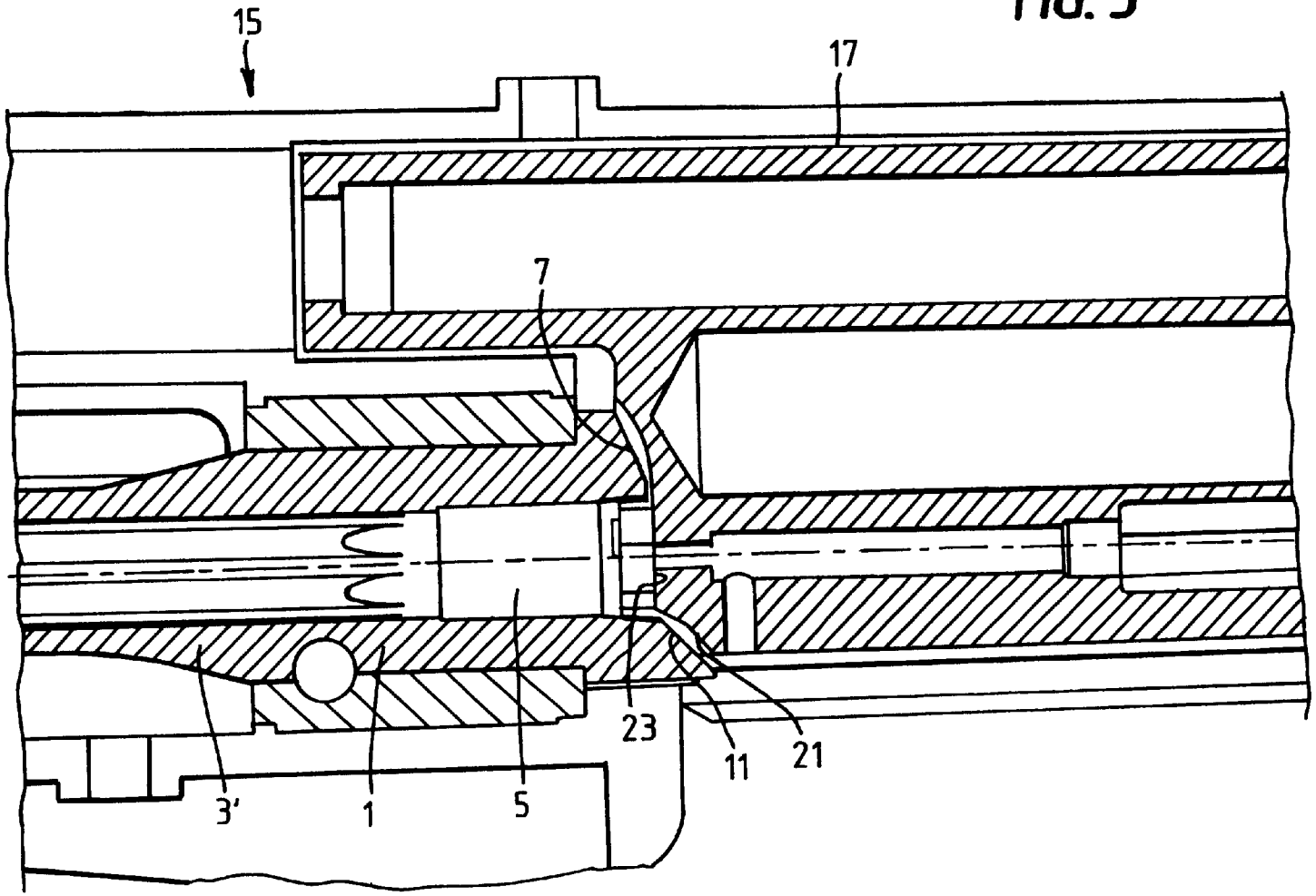
FIG. 3 is a partial longitudinal section (not to scale) through an automatic pistol with the weapon barrel from FIG. 2 in the installed condition and with a corresponding breech.
Figure 4:
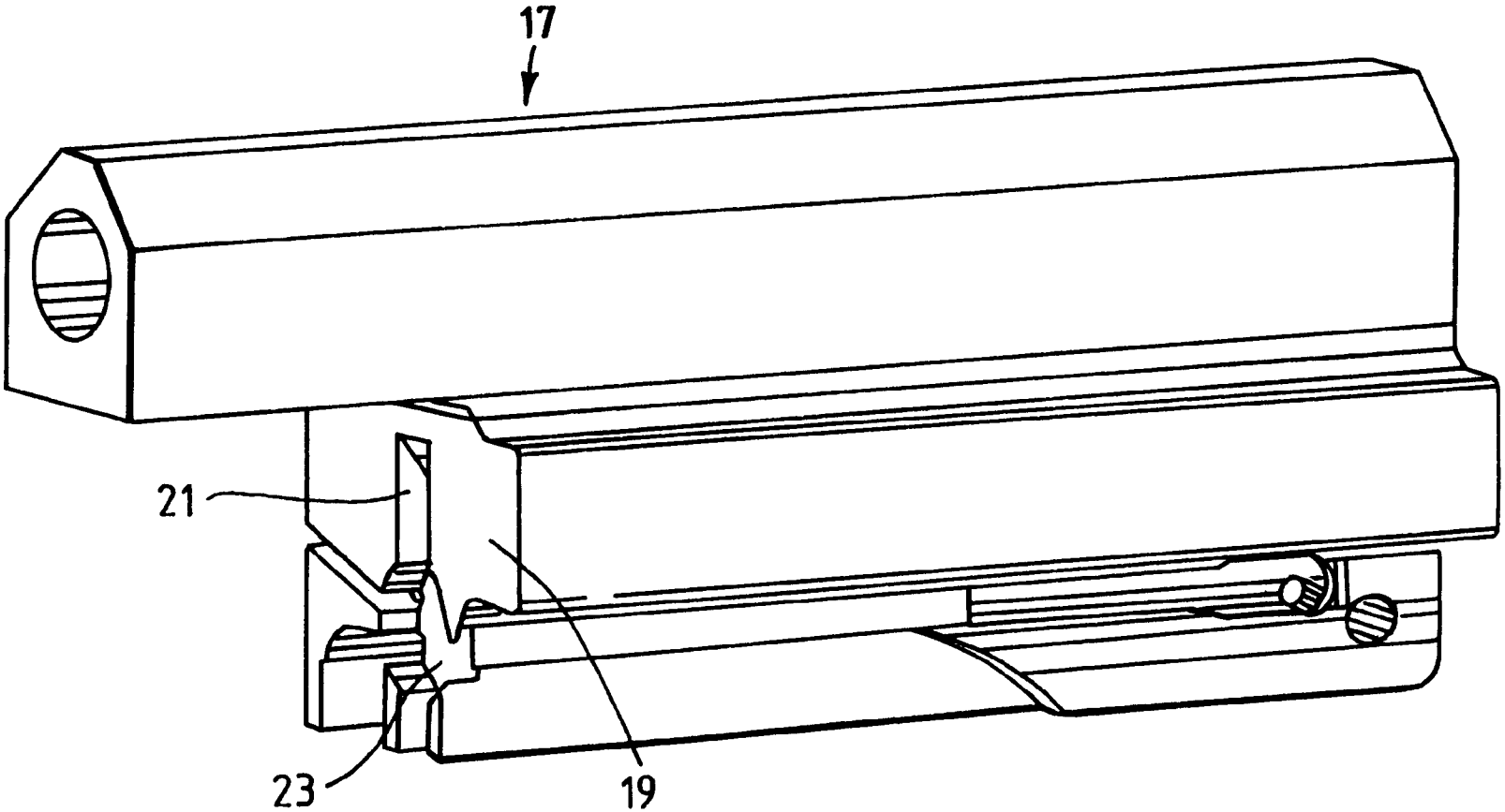
FIG. 4 illustrates the breech of FIG. 3 (but not to scale).

FIGS. 2 to 4 depict an additional barrel (3'). The barrel (3') generally corresponds, in its configuration and its function, to that of the barrel (3). The only differences are the external transition between the rear section (1) and the forward section of the barrel (3'), which is configured differently, and the configuration of the recess (13') for the extraction claw (See FIGS. 5–6) of a corresponding breech (17), which is configured differently and modified slightly.

FIG. 3 depicts the barrel (3') in the installed condition in an automatic pistol (15) with the breech (17) which closes the cartridge chamber (5) off from the rear. The breech (17) (separately shown in FIG. 4), is displaceably supported in the longitudinal direction of the weapon and can thus, in the known manner, carry out a post-loading movement upon the loading or after the firing off of a cartridge.

Figure 5:
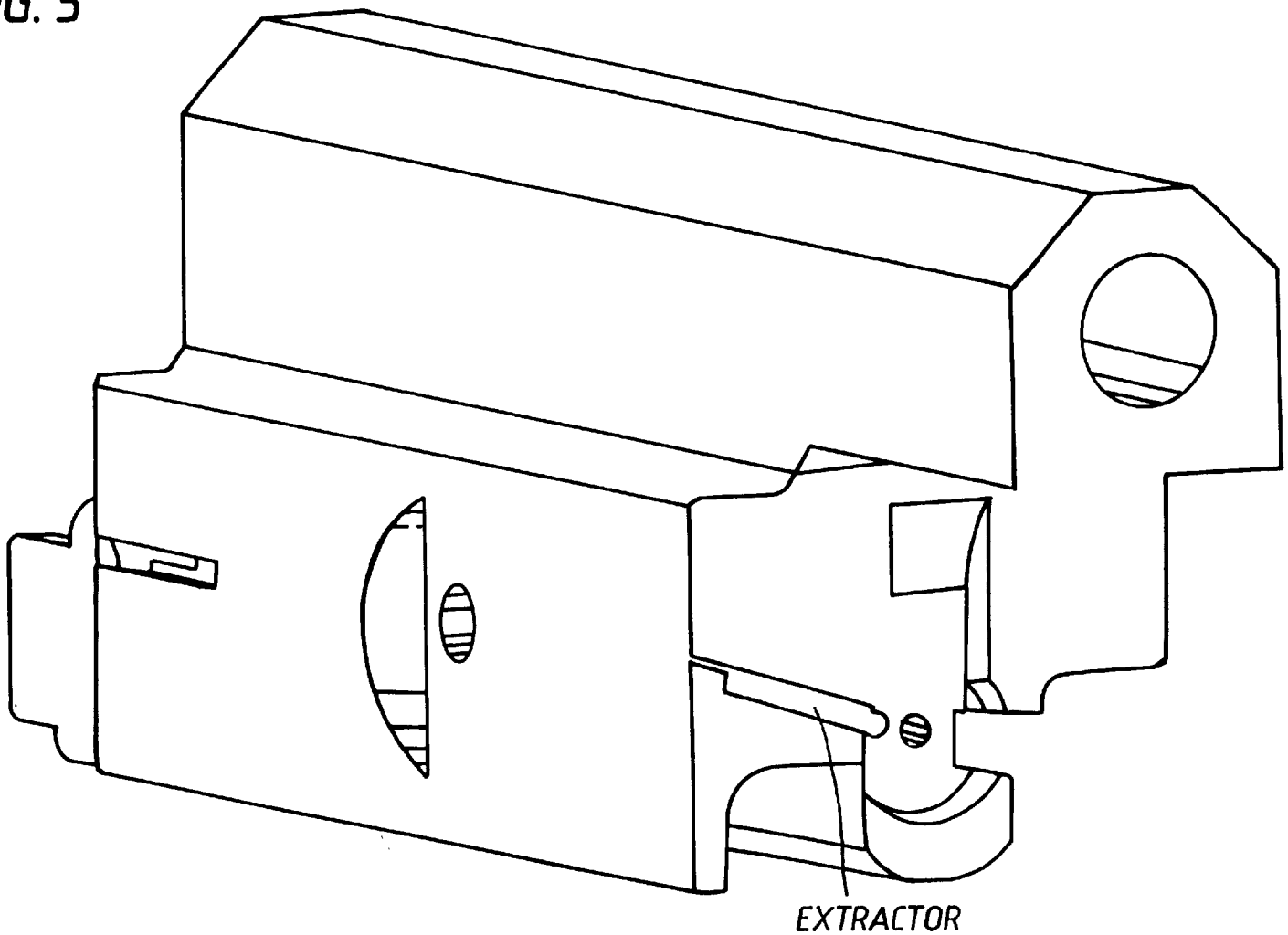
FIG. 5 illustrates the breech of FIG. 4.

It can be seen in FIGS. 4 and 5 that the breech (17) has, on its front surface (19) (in addition to different other recesses which will not be illustrated in further detail here), a slot (21) which extends continuously from a point above an impact base (23) up to the base of the breech (17). The slot (21) serves as a recess for the guiding lug (7) and the feeding incline (11) (see also FIG. 3). The breech (17) is, thus, not restricted in its function and, particularly in this area, also does not need to be further adapted in construction to the barrel (3'), which is designed in a novel manner. The example also shows that the longitudinal dimension of the weapon does not generally have to be enlarged for the application of the illustrated barrels.

It will be appreciated by persons of ordinary skill in the art that a weapon barrel has been disclosed in which the guide element (7) is positioned at the point where the movement of feeding the cartridges into the transverse direction of the weapon that is provided during the loading process ends.

The guide element (7) therefore limits the transverse movement of the cartridges on their path from the transfer position into the cartridge chamber (5). It is positioned in relation to the central axis of the cartridge chamber (5), at the side which lies opposite to the transfer position.

The guide element (7) has another function than the feeding incline that is known from the state of the art. The latter creates a physical transition for the cartridges from the transfer position to the cartridge chamber (5). The guide element (7), on the other hand, prevents transverse movement of the cartridge beyond the extent provided, such as a moving up by the same (a so-called "spike"). Excessive transverse movements can lead to twisting, and thereby to jamming, of the cartridges during the loading process as occurs in repeating weapons that have only simply designed transitions, such as, for example, the magazine lips or recessed notches that have already been mentioned. The weapon barrel thus finds particularly advantageous application in repeating weapons in which—for reasons of cost or manufacturing, for example—precise transitions must be dispensed with. The susceptibility of such weapons to disturbance during the loading process can then be distinctly lowered with the help of the disclosed barrels. The weapon barrel is, however, likewise also suited to increasing the sturdiness of the repeating weapon still further in precisely designed transitions (such as in accordance with the type of solution of the applicant already stated in, for example, DE 195 01 397 A1).

In addition, the disclosed barrel also advantageously usable in weapons in which the transfer position is located directly behind the weapon barrel or the cartridge chamber. In such weapons, a transverse movement of the cartridge is not provided and is, as the result, not desired. Such undesired transverse movements of the cartridges can then also be prevented by the guide element (7).

The disclosed barrels differ from the traditional construction style of known weapon barrels because of the special placement of the guide element (7). Effort was previously expended to keeping the area in front of the mount of the cartridge chamber as free as possible in order to guarantee an ejection of the casing which was as free of disturbance as possible. It would, therefore, be expected, upon the use of the guide element (7) positioned as shown in the figures, that an increased number of load blockages would have to be accepted because of jammings upon the ejection of the casings. The first practice tests, however, have indicated that this is not the case. Instead, the advantages come to fruition without negative side effects.

Figure 7:
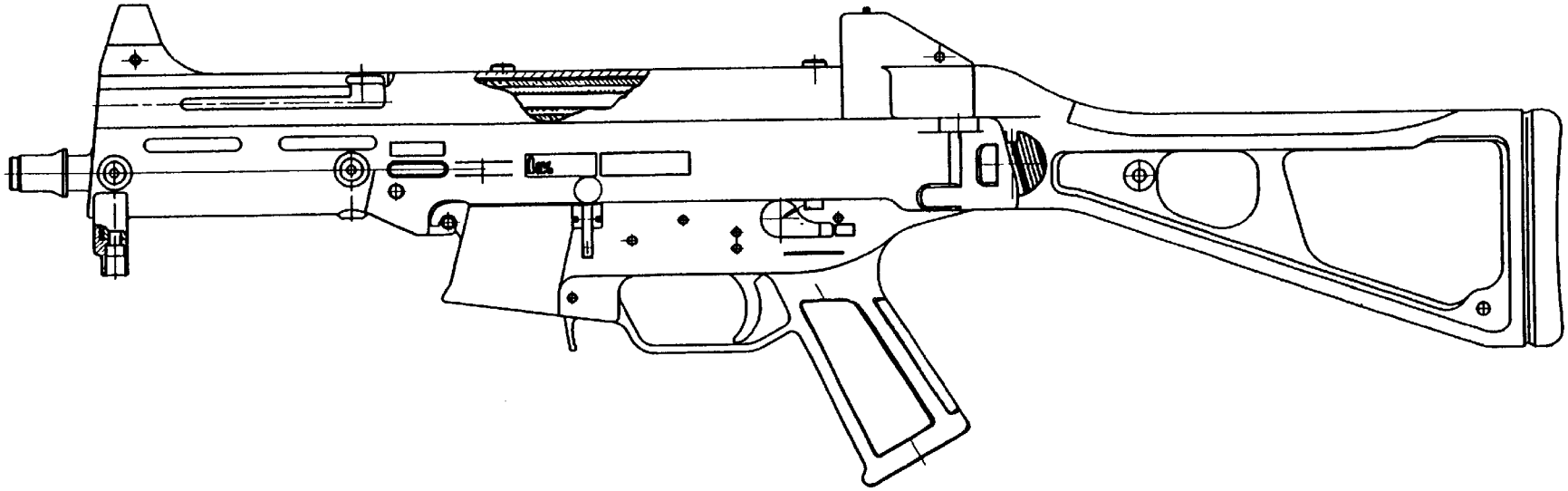
FIG. 7 illustrates an example firearm incorporating the breech of FIG. 3 and either of the weapon barrels shown in FIGS. 1–2.

The disclosed weapon barrels can, in principle, find application in every type of repeating weapon with a conventional manner of construction. However, it may be advantageous or necessary to adjust individual components of the repeating weapon in constructional terms to the new weapon barrel. An example firearm incorporating the barrel and breech mechanism discussed above is shown in FIG. 7.

The guide element (7) can, in principle, be formed as a separate component and attached to the weapon barrel (1) by means of a fixed or detachable connection. The guide element (7) preferably represents an integral component of the weapon barrel (1) so that it is manufactured along with the barrel (1) from one block of material.

In many cases, particularly in hand-held firearms with stick-type magazines, the transfer position(s) of the cartridges is/are located below the cartridge chamber (5). Thus, in one preferred configuration, the guide element (7) is positioned above the cartridge chamber (5). Conversely, in repeating weapons in which the transfer position(s) is positioned above the cartridge chamber (5), the guide element (7) is suitably positioned below the cartridge chamber (5).

The guide element (7) can additionally be positioned in such a manner that its relative position, considered in the circumferential direction of the cartridge chamber (5), is displaced relative to an extracting element attached to the breech. In this manner, it is guaranteed that the function of the extracting element (e.g., extraction claw), is not impaired by the guide element (7). At the same time, the guide element (7) does not lie in the direction of ejection of the casings.

The guide element (7) can alternatively be configured from many parts. Several guide elements (7), which are then preferably distributed over the circumference of the tube, can also be provided.

As has been set forth above, the weapon barrel (1) is suited to supporting any type of cartridge feeding of known repeating weapons. In one preferred configuration, a feeding element (11) extends in the direction of the rear of the weapon and is positioned substantially opposite to the guide element (7). The two guide elements (7), (11) cooperate in the guiding of the cartridges. The feeding element (11) is preferably formed as an integral component of the weapon barrel (1).

The feeding element (11) is preferably structured in such a manner that additional means for guiding the cartridges over the intermediate distance are not necessary in the repeating weapon. In the illustrated device, the feeding of the cartridges is then accomplished through the cooperation of the feeding element (11) with the guide element (7).

For an improved cartridge feeding, the guide element (7) and/or the feeding element (11) (if present) include internal surface(s) which proceed obliquely relative to the central axis of the cartridge chamber (5), at least in sections, so that the distance of the internal surface(s) from the central axis is reduced towards the entrance of the cartridge chamber (5). It is particularly advantageous if the internal surface(s) (7*a*), (11*a*) make a continuous transition into the inner wall of the cartridge chamber (5). If a feeding element (11) is present, then the internal surfaces (7*a*), (11*a*) of both elements (7), (11) preferably proceed together in a wedge-shaped manner.

In addition, the guide element (7) and/or the feeding element (11), if applicable, preferably include internal surface(s) that have, at least in sections, curved cross-section (s) in the form of a circular segment. The curvature of the circular segment(s) preferably corresponds to the radius of curvature of the cartridge chamber (5).

The configurations of the internal surface(s) (7*a*), (11*a*) of the guide element (7) or of the feeding element (11) (slope and curvature) described above represent preferred measures for promoting the sliding of the cartridges into the cartridge chamber (5) in a manner free of disturbance. A combination of both measures is particularly advantageous, since a "breaking out" of the cartridges from the path provided can be prevented still more effectively on such a unit.

The internal surfaces (7*a*), (11*a*) of the guide element (7) and of the feeding element (11) can also proceed together in a wedge-shaped manner. Thus, each can be designed as a segment of a common funnel. The wedge shape can then advantageously be jointly processed on the weapon barrel (1) at the same time as the lathing process.

Persons of ordinary skill in the art will appreciate from the above that the guide element (7) and the feeding element (11) are primarily intended to guarantee a cartridge feeding that is as free of disturbance as possible. The guide element (7) is, particularly in the cooperation with the feeding element (11), additionally suited to centering the breech (or, if applicable, the breech head) upon closing off the cartridge chamber (5). The breech is then adjusted in its configuration in such a manner that the feeding element (11) can fulfill the centering function.

The above statements on the weapon barrel are also applicable, in their complete contents, for a repeating weapon (e.g., a semi-automatic or fully automatic weapon), employing the barrel (1). In such a weapon the cartridges are, during the loading process, conveyed to the weapon barrel (1) and moved in the longitudinal and transverse directions toward a cartridge chamber (5) for receiving the cartridges. A guide element (7) is contiguous with the cartridge chamber (5), whereby the guide element (7) extends in the direction of the rear of the weapon and is configured such that it guides the cartridges and is positioned where the transverse movement of the cartridges provided ends during the loading process.

Although certain apparatus constructed in accordance with the teachings of the invention have been described herein, the scope of coverage of this patent is not limed thereto. On the contrary, this patent covers all embodiments of the teachings of the invention fairly falling within the scope of the appended claims either literally or under the doctrine of equivalents.

What is claimed is:

1. For use with a cartridge, a firearm having a longitudinal axis wherein, during a loading process, the cartridge experiences a transverse movement relative to the longitudinal axis and a longitudinal movement in a direction of the longitudinal axis, the firearm comprising:

a housing;

a breech block mounted for movement within the housing; and a barrel comprising:

a cartridge chamber having an internal surface with a curvature; and a guide element located adjacent to and extending away from the cartridge chamber, the guide element being further located at a point where the transverse movement of the cartridge ends during the loading process, the guide element having a surface, at least a portion of the surface of the guide element having a curved shape whose curvature corresponds to the curvature of the internal surface of the cartridge chamber, wherein the breech block defines a slot to receive the guide element when the breech block is positioned adjacent the cartridge chamber.

2. A firearm as defined in claim 1 wherein the at least a portion of the surface of the guide element is contiguous with the internal surface of the cartridge chamber.

3. A firearm as defined in claim 1 wherein the guide element is integral with the barrel.

4. A firearm as defined in claim 1 wherein the guide element is positioned above the cartridge chamber.

5. A firearm as defined in claim 1 wherein the barrel defines a recess for an extracting element carried by the breech block, and the guide element is displaced relative to the recess to avoid interference with the extracting element.

6. A firearm as defined in claim 1 further comprising a feeding element located adjacent to and extending away from the cartridge chamber, the feeding element being positioned substantially opposite the guide element relative to the cartridge chamber to cooperate with the guide element to guide the cartridges into the cartridge chamber.

7. A firearm as defined in claim 6 wherein the feeding element has a surface, and at least a portion of the surface of the feeding element has a curved shape whose curvature corresponds to the curvature of the internal surface of the cartridge chamber.

8. A firearm as defined in claim 7 wherein the at least the portion of the surface of the feeding element is oriented at an angle relative to a central axis of the cartridge chamber so that a distance between the at least the portion of the surface of the feeding element and the central axis decreases near the cartridge chamber.

9. A firearm as defined in claim 8 wherein the at least the portion of the surface of the guide element is oriented at an angle relative to the central axis of the cartridge chamber so that a distance between the at least the portion of the surface of the guide element and the central axis decreases near the cartridge chamber.

10. A firearm as defined in claim 1 wherein the at least the portion of the surface of the guide element is oriented at an angle relative to a central axis of the cartridge chamber so that a distance between the at least the portion of the surface of the guide element and the central axis decreases near the cartridge chamber.

11. A firearm as defined in claim 6 wherein at least one of the guide element and the feeding element makes a continuous transition into the cartridge chamber.

12. A firearm as defined in claim 1 wherein the guide element makes a continuous transition into the cartridge chamber.

13. A firearm as defined in claim 1 wherein the firearm is an automatic weapon.

14. A firearm as defined in claim 1 wherein the firearm is a semiautomatic weapon.

* * * * *